US009182165B2

(12) United States Patent
Lee et al.

(10) Patent No.: US 9,182,165 B2
(45) Date of Patent: Nov. 10, 2015

(54) RAPID CRYOCOOLER UTILIZING SPRAY HOLES TO COOL A BEVERAGE

(75) Inventors: Youn Seok Lee, Seoul (KR); Yeon Woo Cho, Seoul (KR); Yang Gyu Kim, Seoul (KR); Deul Re Min, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 814 days.

(21) Appl. No.: 13/497,596

(22) PCT Filed: Sep. 8, 2010

(86) PCT No.: PCT/KR2010/006109

§ 371 (c)(1),
(2), (4) Date: Jul. 2, 2012

(87) PCT Pub. No.: WO2011/037342

PCT Pub. Date: Mar. 31, 2011

(65) Prior Publication Data

US 2012/0266627 A1 Oct. 25, 2012

(30) Foreign Application Priority Data

Sep. 23, 2009 (KR) ..... 10-2009-0090184

(51) Int. Cl.
*F25D 17/02* (2006.01)
*F25D 11/00* (2006.01)

(52) U.S. Cl.
CPC ..... *F25D 17/02* (2013.01); *F25D 11/006* (2013.01); *F25D 2331/803* (2013.01); *F25D 2331/805* (2013.01); *F25D 2400/06* (2013.01); *F25D 2400/28* (2013.01); *F25D 2400/30* (2013.01)

(58) Field of Classification Search
CPC ..... F25D 2331/805; F25D 2331/30; F25D 2400/28
USPC ..... 62/373, 376, 64
See application file for complete search history.

(56) References Cited

U.S. PATENT DOCUMENTS

| | | | | |
|---|---|---|---|---|
| 4,655,047 | A * | 4/1987 | Temple et al. | 62/64 |
| 4,982,577 | A | 1/1991 | Milankov et al. | 62/381 |
| 5,170,631 | A * | 12/1992 | Lang et al. | 62/63 |
| 2002/0124576 | A1 * | 9/2002 | Loibl et al. | 62/64 |
| 2006/0185372 | A1 * | 8/2006 | Conde Hinojosa | 62/64 |

FOREIGN PATENT DOCUMENTS

| | | | |
|---|---|---|---|
| JP | 64-22977 | U | 2/1989 |
| JP | 2004-226060 | A | 8/2004 |
| JP | 2009058212 | A * | 3/2009 |

OTHER PUBLICATIONS

Lee, Quick Cooling Device, Dec. 8, 2004, PAJ, JP 2004-226060, all.*
International Search Report dated Apr. 25, 2011 issued in Application No. PCT/KR2010/006109.

* cited by examiner

*Primary Examiner* — Allen Flanigan
*Assistant Examiner* — Filip Zec
(74) *Attorney, Agent, or Firm* — Ked & Associates LLP

(57) ABSTRACT

A refrigerator is disclosed. The refrigerator includes a refrigerator body having a storage chamber defined therein, a refrigeration cycle device for cooling the storage chamber, a chilling case for receiving a beverage container such that the chilling case surrounds the beverage container in a contact manner, and a rapid cooling device, having a case receiving part for receiving the chilling case, for cooling a coolant using the refrigeration cycle device and spraying the cooled coolant to an outside of the chilling case in a vicinity of the chilling case. A beverage is cooled in a state in which the beverage container is not in direct contact with the coolant, whereby the coolant is not present at the outside of the beverage container, and therefore, the beverage container is kept sanitary.

20 Claims, 10 Drawing Sheets

RAPID CRYOCOOLER UTILIZING SPRAY HOLES TO COOL A BEVERAGE

TECHNICAL FIELD

The present invention relates to a refrigerator, and more particularly to a refrigerator that is capable of rapidly cooling beverages using a coolant cooled by a refrigeration cycle device.

BACKGROUND ART

Generally, a refrigerator is an apparatus that cools storage chambers, such as a refrigerating chamber and a freezing chamber, using a refrigeration cycle device including a compressor, a condenser, an expansion mechanism, and an evaporator.

In recent years, a rapid cooling chamber has been additionally formed at one side of the refrigerating chamber or the freezing chamber such that some cool air in the refrigerating chamber or the freezing chamber is supplied to the rapid cooling chamber for rapidly cooling objects to be cooled in the rapid cooling chamber.

In conventional refrigerators, however, rapid cooling time is considerably long since some cool air in the refrigerating chamber or the freezing chamber is supplied to the rapid cooling chamber. Also, objects are cooled in a state in which the objects are fixed, with the result that the objects are not moved, and the rapid cooling is delayed.

DISCLOSURE

Technical Problem

Therefore, the present invention has been made in view of the above problems, and it is an object of the present invention to provide a refrigerator that is capable of cleanly cooling a beverage container in a state in which a coolant is not in contact with the outside of the beverage container.

It is another object of the present invention to provide a refrigerator that is capable of preventing a coolant from being discharged to the outside, thereby achieving long-term use of the coolant.

It is a further object of the present invention to provide a refrigerator that is capable of accelerating heat exchange between a beverage and a coolant, thereby more rapidly cooling the beverage.

Technical Solution

In accordance with the present invention, the above and other objects can be accomplished by the provision of a refrigerator including a refrigerator body having a storage chamber defined therein, a refrigeration cycle device for cooling the storage chamber, a chilling case for receiving a beverage container such that the chilling case surrounds the beverage container in a contact manner, and a rapid cooling device, having a case receiving part for receiving the chilling case, for cooling a coolant using the refrigeration cycle device and spraying the cooled coolant to an outside of the chilling case in a vicinity of the chilling case.

The chilling case may include a heat transmission bag disposed in contact with the beverage container such that the heat transmission bag 21 is deformed in correspondence to a shape of the beverage container and a heat transmission material disposed in the heat transmission bag.

The rapid cooling device may include a rapid cooling body, in which the case receiving part is defined, having a plurality of spray holes for spraying the coolant to the outside of the chilling case.

The chilling case may include a cylindrical body received in the case receiving part, the cylindrical body having a beverage inlet and output port formed at a top thereof, the cylindrical body having a closed circumferential part and a closed bottom, and a cover protruding from the cylindrical body for closing a space defined between the cylindrical body and an upper end of the case receiving part.

The refrigerator may further include a rapid cooling body rotating mechanism for rotating the rapid cooling body.

The chilling case may be provided at a top thereof with a beverage inlet and output port, and the rapid cooling body rotating mechanism may be mounted below the rapid cooling body.

The refrigerator may further include a vibration exciter mounted at the rapid cooling body for exciting the rapid cooling body.

The refrigerator may further include a plurality of dampers mounted at a bottom of the outer cylindrical body for supporting the rapid cooling body.

The rapid cooling body may include an inner cylindrical body, in which the case receiving part is defined and through which the spray holes are formed to spray the coolant to a circumferential part of the chilling case, an outer cylindrical body surrounding the inner cylindrical body for defining an internal channel for allowing a coolant to pass therethrough between the inner cylindrical body and the outer cylindrical body, a top plate for closing an upper end of the rapid cooling body between the inner cylindrical body and the outer cylindrical body, and a bottom plate for closing a lower end of the outer cylindrical body.

The rapid cooling device may include a coolant cooler, having a coolant channel for allowing the coolant to pass therethrough, for performing heat exchange between the coolant and a refrigerant of the refrigeration cycle device to cool the coolant, a coolant supply channel for guiding the coolant cooled by the coolant cooler to the rapid cooling body, a coolant collection channel for guiding the coolant discharged from the rapid cooling body to the coolant cooler, and a circulation pump mounted on the coolant supply channel and/or the coolant collection channel for circulating the coolant.

The coolant supply channel may be connected to a top of the rapid cooling body, and the coolant collection channel may be connected to a bottom of the rapid cooling body.

The coolant cooler may include a heat exchanger mounted at a surface of an evaporator of the refrigeration cycle device in a surface contact manner.

The coolant cooler may include a heat exchanger connected in parallel to an evaporator of the refrigeration cycle device for performing heat exchange between a refrigerant channel, through which a refrigerant flows, and a coolant channel.

The coolant cooler may include a heat exchanger connected in series to an evaporator of the refrigeration cycle device for performing heat exchange between a refrigerant channel, through which a refrigerant flows, and a coolant channel.

DESCRIPTION OF DRAWINGS

The above and other objects, features and other advantages of the present invention will be more clearly understood from the following detailed description taken in conjunction with the accompanying drawings, in which.

BEST MODE

Figure 1:
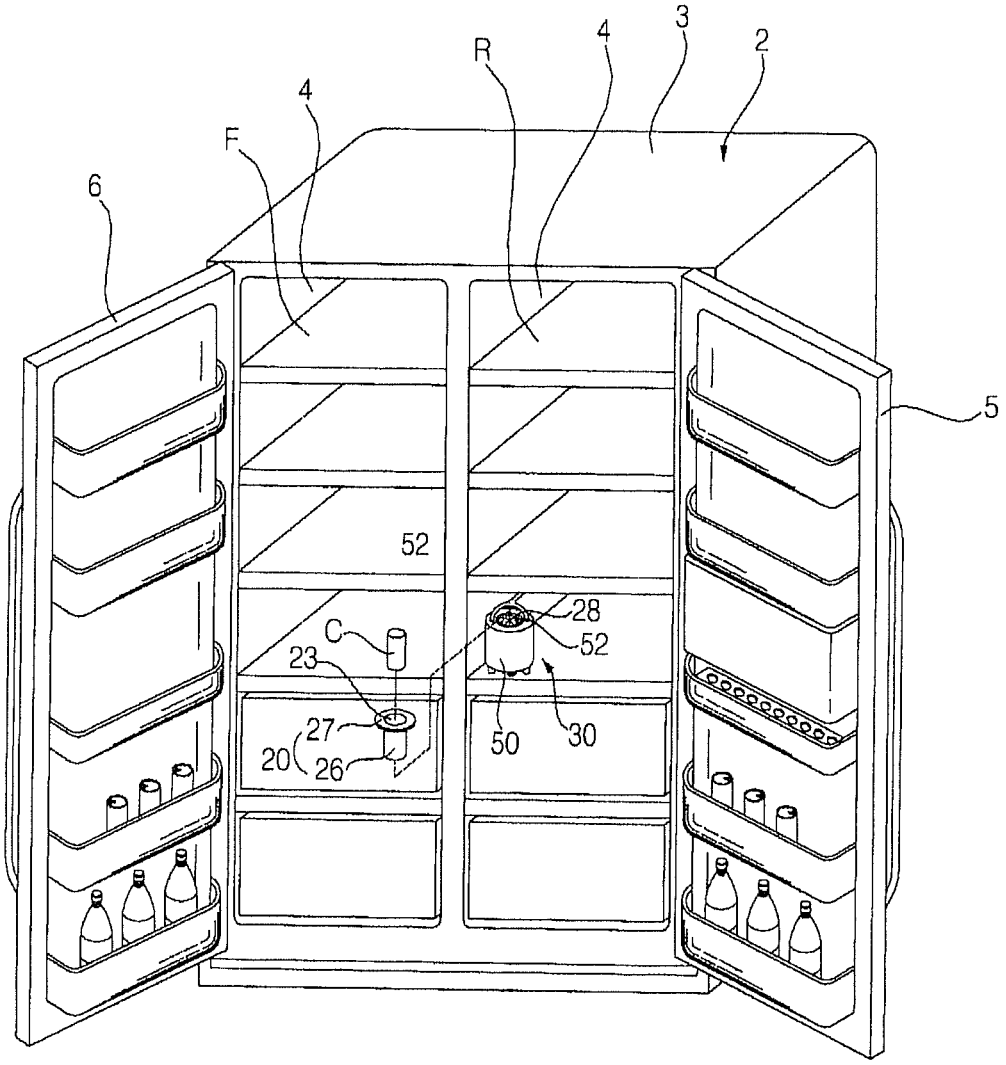
FIG. 1 is a perspective view illustrating a refrigerator according to a first embodiment of the present invention.

Now, preferred embodiments of the present invention will be described in detail with reference to the accompanying drawings. The same or similar elements are denoted by the same reference numerals even though they are depicted in different drawings, and a detailed description thereof will be omitted.

Figure 2:
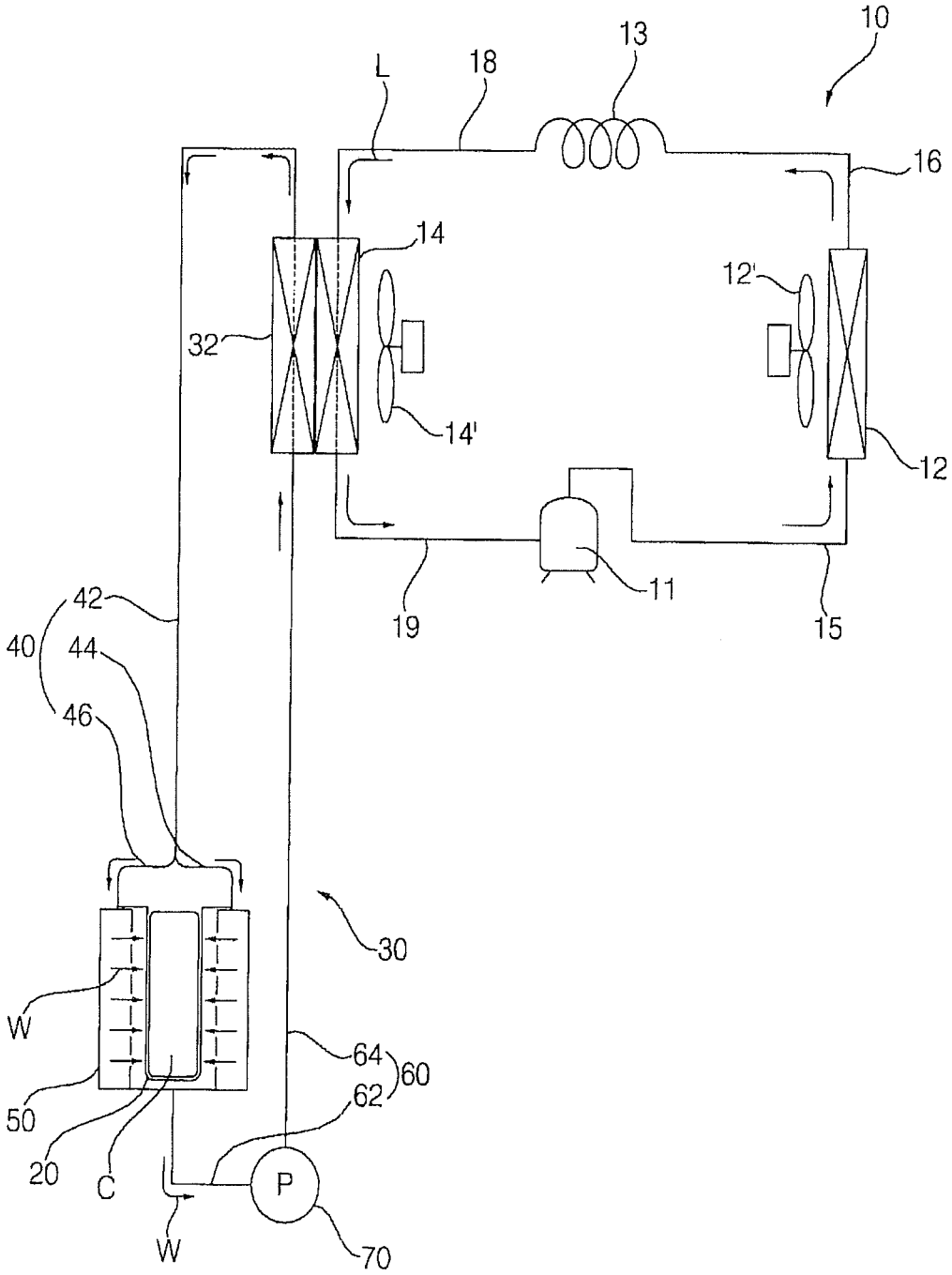
FIG. 2 is a construction view schematically illustrating the flow of a refrigerant and a coolant in the refrigerator according to the first embodiment of the present invention.
Figure 3:
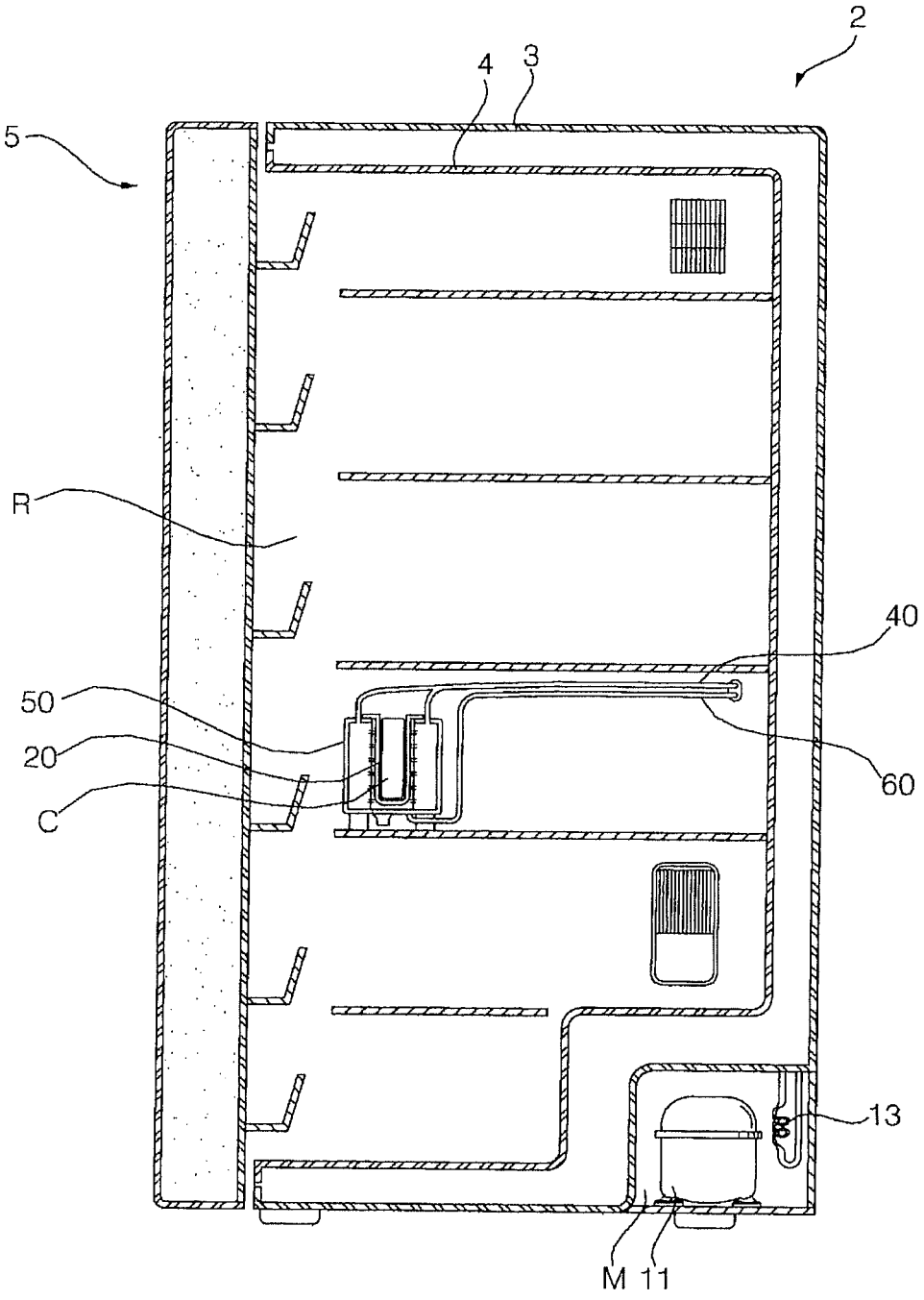
FIG. 3 is a vertical sectional view illustrating the interior of the refrigerator according to the first embodiment of the present invention.
Figure 4:
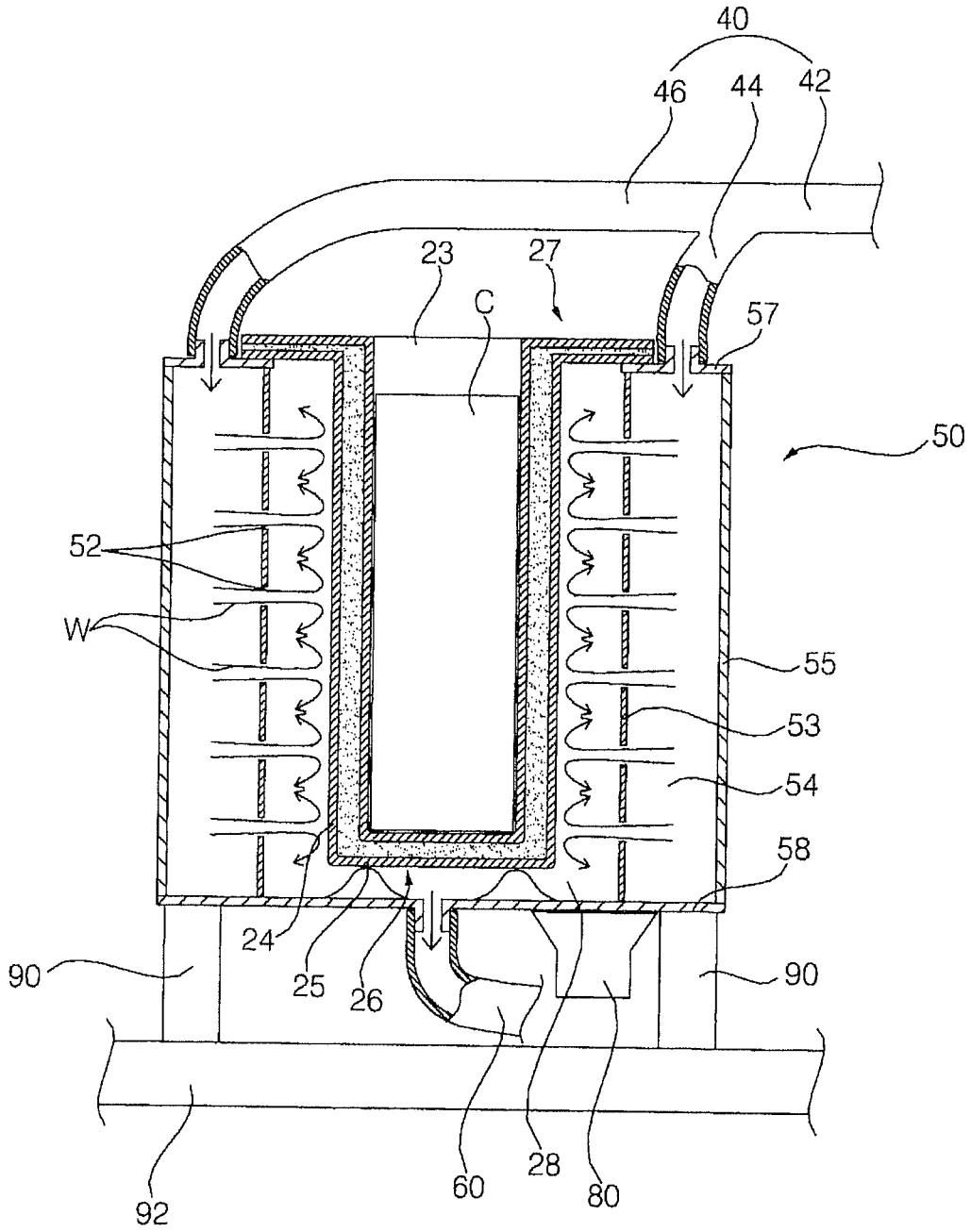
FIG. 4 is an enlarged vertical sectional view illustrating a rapid cooling body shown in FIGS. 1 to 3.
Figure 5:
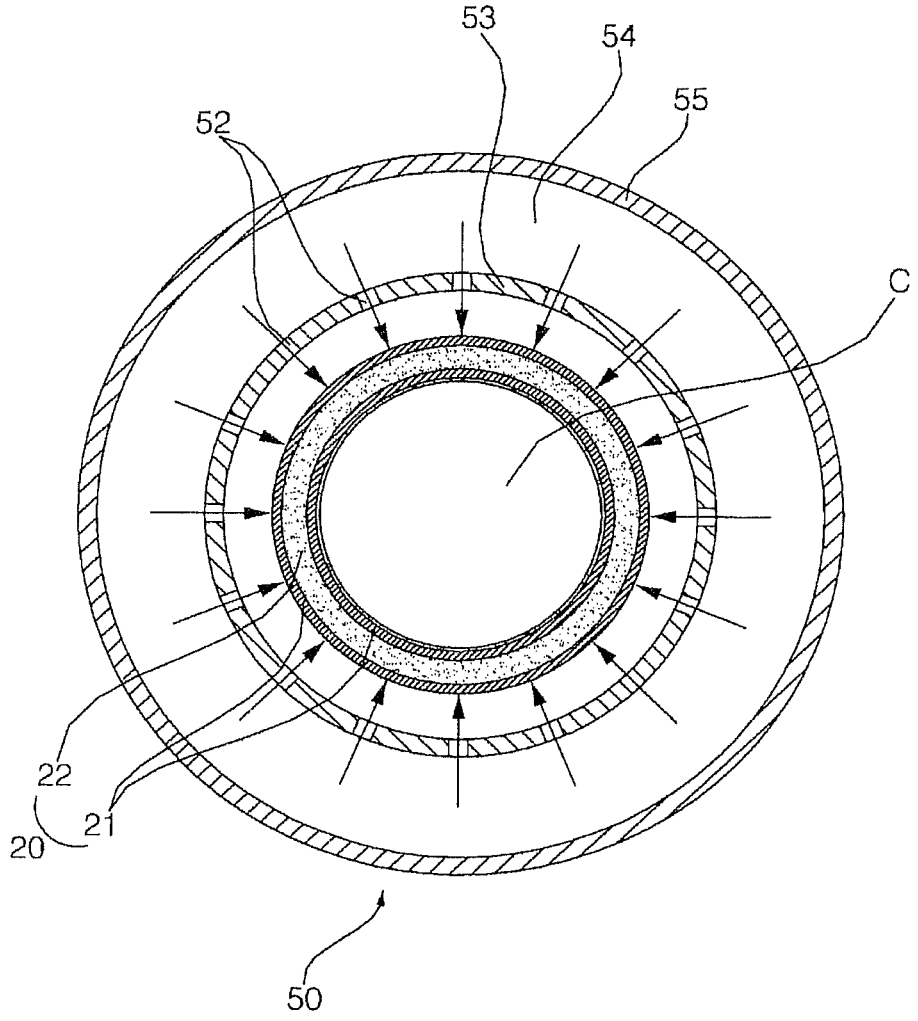
FIG. 5 is an enlarged plan sectional view of the rapid cooling body shown in FIGS. 1 to 3.

FIG. 1 is a perspective view illustrating a refrigerator according to a first embodiment of the present invention, FIG. 2 is a construction view schematically illustrating the flow of a refrigerant and a coolant in the refrigerator according to the first embodiment of the present invention, FIG. 3 is a vertical sectional view illustrating the interior of the refrigerator according to the first embodiment of the present invention, FIG. 4 is an enlarged vertical sectional view illustrating a rapid cooling body shown in FIGS. 1 to 3, and FIG. 5 is an enlarged plan sectional view of the rapid cooling body shown in FIGS. 1 to 3.

As shown in FIGS. 1 to 5, the refrigerator according to this embodiment includes a refrigerator body 2 having storage chambers F and R defined therein, a refrigeration cycle device 10 for cooling the storage chambers F and R, a chilling case 20 for receiving a beverage container C such that the chilling case 20 surrounds the beverage container C in a contact manner, and a rapid cooling device 30, having a case receiving part 28 for receiving the chilling case 20, for cooling a coolant. W using the refrigeration cycle device 10 and spraying the cooled coolant. W to the outside of the chilling case 20 in the vicinity of the chilling case 20.

The refrigerator body 2 includes an outer case 3, an inner case 4 disposed inside the outer case 3, the inner case 4 defining the storage chambers F and R, and doors 5 and 6 for opening and closing the storage chambers F and R, respectively.

A heat insulation material, such as form plastic, is disposed between the outer case 3 and the inner case 4 of the refrigerator body 2. Also, a heat insulation material, such as form plastic, is disposed in the doors 5 and 6.

As shown in FIG. 2, the refrigeration cycle device 10 includes a compressor 11 for compressing a refrigerant. L, a condenser 12 for condensing the refrigerant. L compressed by the compressor 11, an expander 13 for expanding the refrigerant. L condensed by the condenser 12, and an evaporator 14 for evaporating the refrigerant L expanded by the expander 13 to cool the storage chambers F and R.

The compressor 11 compresses a low-temperature, low-pressure gas refrigerant L into a high-temperature, high-pressure gas refrigerant L. The compressor 11 is mounted in a machine room M defined in the refrigerator body 2 such that the machine room M is separated from the storage chambers F and R.

The condenser 12 is connected to the compressor 11 via a condenser inlet pipe 15. Also, the condenser 12 is connected to the expander 13 via a condenser outlet pipe 16. A refrigerant L, introduced from the compressor 11 via the condenser inlet pipe 15, is condensed by the condenser 12 while the refrigerant flows through the condenser 12, and is then discharged via the condenser outlet pipe 16.

The condenser 12 may be mounted at the rear of the refrigerator body 2 such that the condenser 12 is exposed to the outside. Alternatively, the condenser 12 may be mounted in the machine room M defined in the refrigerator body 2. In a case in which the condenser 12 is mounted in the machine room M, a condensing fan 12' for blowing air outside the refrigerator body 2 to the condenser 12 is mounted in the refrigerator body 2.

The expander 13 may be embodied by a capillary tube or an electronic expansion valve. The expander 13 expands the condensed refrigerant L discharged via the condenser outlet pipe 16.

The evaporator 14 is connected to the expander 13 via an evaporator inlet pipe 18. Also, the evaporator 14 is connected to the compressor 11 via an evaporator outlet pipe 19. A refrigerant L, introduced from the expander 13 via the evaporator inlet pipe 18, is expanded by the evaporator 14 while the refrigerant flows through the evaporator 14, is discharged via the evaporator outlet pipe 16, and flows to the compressor 11.

The evaporator 14 may be configured as a direct cooling type evaporator disposed at the outer walls of the storage chambers F and R in a contact manner to directly cool the storage chambers F and R. Alternatively, the evaporator 14 may be configured as an indirect cooling type evaporator for circulating air through the storage chambers F and R and the evaporator 14 for cooling the storage chambers F and R in a circulation manner. In a case in which the evaporator 14 is configured as the indirect cooling type evaporator, a circulation fan 14' for circulating air through the storage chambers F and R and the evaporator 14 is mounted in the refrigerator body 2.

The evaporator 14 may be embodied by a fin-tube type heat exchanger including a refrigerant pipe for allowing a refrigerant L to pass therethrough and a heat transmission fin mounted in the refrigerant pipe.

The chilling case 20 supports and cools the beverage container C while the external appearance of the chilling case 20 is deformed according to the size and shape of the beverage container C. The chilling case 20 includes a heat transmission bag 21 disposed in contact with the beverage container C such that the heat transmission bag 21 is deformed according to the shape of the beverage container C and a heat transmission material 22 disposed in the heat transmission bag 21.

The heat transmission bag 21 is formed of a flexible material exhibiting high thermal conductivity. The heat transmission bag 21 is filled with the heat transmission material 22 in an airtight manner.

The heat transmission bag 21 may be formed of a variable metal the shape of which is deformed by the beverage container C when the beverage container C is inserted into the heat transmission bag 21. Alternatively, the heat transmission bag 21 may be formed of a synthetic resin the shape of which is deformed by the beverage container C when the beverage container C is inserted into the heat transmission bag 21.

The heat transmission material 22 is a cold storage medium having high thermal conductivity. The heat transmission material 22 is cooled by the coolant W of the rapid cooling device 3. Heat from a beverage is transmitted to the heat transmission material 22 via the beverage container C and the inside of the heat transmission bag 21, and is then transmitted to the coolant W via the outside of the heat transmission bag 21.

The heat transmission material 22 is composed of silicone, salt water, or a mixture of alcohol and water. It is preferable for the heat transmission material 22 to be formed of a liquid heat transmission material which is harmless to humans when the heat transmission bag 21 is punctured.

The chilling case 20 includes a cylindrical body 26 received in the case receiving part 28, the cylindrical body 26 having a beverage inlet and output port 23 formed at the top thereof, the cylindrical body 26 having a closed circumferential part 24 and a closed bottom 25, and a cover 27 protruding from the cylindrical body 26 for closing a space defined between the cylindrical body 26 and the upper end of the case receiving part 28.

The cylindrical body 26 contacts the beverage container C in a surface contact manner for substantially cooling the beverage container C. The cylindrical body 26 is formed in the shape of a cylinder the top and interior of which are open.

The cover 27 prevents a coolant W sprayed to the case receiving part 28 from being discharged to the outside through the top of the case receiving part 28.

The cover 27 supports the cylindrical body 26 such that the cylindrical body 26 is spaced apart from the bottom of a rapid cooling body 50, which will be described later, of the rapid cooling device 30. The cover 27 is hung from the upper end of the rapid cooling body 50.

The cover 27 protrudes from the upper end of the cylindrical body 26 in the radial direction thereof. The cover is formed generally in the shape of a hollow disc.

The rapid cooling device 30 is a chilling case cooling device for supplying a coolant to the chilling case 20 in the vicinity of the chilling case 20 to cool the chilling case 20. The rapid cooling device 30 includes a coolant cooler 32 for cooling a coolant W using the refrigeration cycle device 10, a coolant supply channel 40 for guiding the coolant W cooled by the coolant cooler 32, a rapid cooling body 50 for spraying the coolant W guided along the coolant supply channel 40 to the outside of the chilling case 20, a coolant collection channel 60 for guiding the coolant W discharged from the rapid cooling body 50 to the coolant cooler 32, and a circulation pump 70 mounted on the coolant supply channel 40 and/or the coolant collection channel 60 for circulating the coolant W.

A coolant W is a kind of heat transmission fluid for collecting heat transmitted to a beverage, in particular, heat transmitted from the beverage to the chilling case 20 and transmitting the collected heat to a refrigerant. The coolant W is composed of salt water or a mixture of alcohol and water.

The coolant cooler 32 performs heat exchange between the coolant W and the refrigerant of the refrigeration cycle device 10 to cool the coolant W. The coolant cooler 32 has a coolant channel in which the coolant W is cooled while the coolant W flows along the coolant channel.

The coolant cooler 32 includes a heat exchanger mounted at the surface of the evaporator 14 of the refrigeration cycle device 10 in a surface contact manner. Heat from the coolant W is transmitted to the surface of the coolant cooler 32 and the surface of the evaporator 14, with the result that the coolant W is cooled.

The coolant cooler 32 may by embodied by a coolant pipe disposed at the heat transmission fin of the evaporator 14 for allowing the coolant W to flow therethrough. Alternatively, the coolant cooler 32 may include a coolant pipe for allowing the coolant W to flow therethrough and a heat transmission fin mounted in the coolant pipe in a state in which the heat transmission fin coolant cooler 32 is in contact with the heat transmission fin of the evaporator 14.

The coolant cooler 32 may be embodied by a coolant pipe for allowing the coolant W to flow therethrough. The heat transmission fin of the evaporator 14 may be provided with a refrigerant pipe through hole, through which the refrigerant pipe of the evaporator 14 extends, and a coolant pipe through hole, through which the coolant pipe extends, such that the refrigerant pipe and the coolant pipe extend through the heat transmission fin. That is, the heat transmission fin, the refrigerant pipe, and the coolant pipe may be formed as a single unit.

The coolant supply channel 40 includes a common channel 42 connected to the coolant cooler 32 and a plurality of branch channels 44 and 46 connected between the common channel 42 and the rapid cooling body 50.

The branch channels 44 and 46 distribute the coolant into a plurality of points of the rapid cooling body 50. One end of each of the branch channels 44 and 46 is connected to the common channel 42, and the other end of each of the branch channels 44 and 46 is connected to the rapid cooling body 50.

The coolant supply channel 40 is embodied by a tube or a hose for connecting the outlet of the coolant cooler 32 to the inlet of the rapid cooling body 50.

The rapid cooling body 50 has a case receiving part 28 for receiving the chilling case 20 and a plurality of spray holes 52 for spraying the coolant W guided along the coolant supply channel 40 to the outside of the chilling case 20.

The rapid cooling body 50 may be mounted in the storage chamber F and R. Alternatively, the rapid cooling body 50 may be mounted in the doors 5 and 6.

The rapid cooling body 50 includes an inner cylindrical body 53, through which the spray holes 52 are formed and in which the case receiving part 28 is defined, and an outer cylindrical body 55 surrounding the inner cylindrical body 53 for defining an internal channel 54 for allowing a coolant W to pass therethrough between the inner cylindrical body 53 and the outer cylindrical body 55.

The inner cylindrical body 53 is formed in the shape of a cylinder the top and bottom of which are open. The case receiving part 28 is defined in the inner cylindrical body 53.

A plurality of spray holes 52 are formed in the vertical direction of the inner cylindrical body 53 and in the circumferential direction of the inner cylindrical body 53 for spraying a coolant W to the circumference of the chilling case 20 in the vicinity of the chilling case 20 at high speed.

A jet of the coolant W is created in the vicinity of the chilling case 20 through high-speed spray of the coolant W through the spray holes 52 of the inner cylindrical body 53. The diameter of the spray holes 52 may be uniform toward the case receiving part 28. Alternatively, the diameter of the spray holes 52 may be gradually decreased toward the case receiving part 28.

The spray holes 52 of the inner cylindrical body 53 are formed such that the spray holes 52 are opened toward the center of the case receiving part 28, and therefore, the coolant W, passing through the spray holes 52, is directed to the center of the case receiving part 28.

That is, the rapid cooling body 50 sprays the coolant W in the direction perpendicular to the chilling case 20, with the result that an impinging jet of the coolant W is maximized, thereby greatly improving heat transmission efficiency.

The outer cylindrical body 55 forms the external appearance of the rapid cooling body 50. The outer cylindrical body 55 is disposed such that the outer cylindrical body 55 surrounds the outer circumference of the inner cylindrical body 53 for defining an internal channel 54 between the inner cylindrical body 53 and the outer cylindrical body 55.

The outer cylindrical body 55 is formed in the shape of a cylinder the top and bottom of which are open.

The rapid cooling body 50 further includes a top plate 57 for closing the upper end of the rapid cooling body 50 between the inner cylindrical body 53 and the outer cylindrical body 55 and a bottom plate 58 for closing the lower end of the outer cylindrical body 55.

The top plate 57 opens the top of the case receiving part 28 such that the cylindrical body 26 of the chilling case 20 is received into or removed from the case receiving part 28. The top plate 57 is formed in the shape of a hollow disc.

The rapid cooling body 50 is formed such that the inner cylindrical body 53 has a larger diameter than that of the cylindrical body 26 of the chilling case 20 and a smaller diameter than the outer diameter of the cover 27 of the chilling case 20.

The bottom plate 58 closes the lower end of the inner cylindrical body 53 and the lower end between the inner cylindrical body 53 and the outer cylindrical body 55. The bottom plate 58 forms the external appearance of the lower part of the rapid cooling body 50.

The center of the bottom plate 58 forms the case receiving part 28 together with the inner cylindrical body 53, and the outside of the bottom plate 58 forms the internal channel 54 together with the inner cylindrical body 53 and the outer cylindrical body 55.

The rapid cooling body 50 may be configured such that the top plate 57 or the bottom plate 58 is integrally formed with the inner cylindrical body 53 or the outer cylindrical body 55.

Meanwhile, the coolant supply channel 40 and the coolant collection channel 60 are connected to the rapid cooling body 50. The coolant supply channel 40 is communicably connected to the internal channel 54 of the rapid cooling body 50, and the coolant collection channel 60 is communicably connected to the case receiving part 28 of the rapid cooling body 50.

Since gravity is applied to the coolant W, it is preferable for the coolant W to be supplied through the top of the rapid cooling body 50 and to be discharged through the bottom of the rapid cooling body 50. The coolant supply channel 40 is connected to the top of the rapid cooling body 50, and the coolant collection channel 60 is connected to the bottom of the rapid cooling body 50, in particular, the bottom of the case receiving part 28.

That is, a supply channel connection part 57*a*, to which the coolant supply channel 40 is connected, is formed at the top of the rapid cooling body 50, and a collection channel connection part 58*a*, to which the coolant collection channel 60 is connected, is formed at the bottom of the rapid cooling body 50.

The coolant collection channel 60 is embodied by a tube or a hose for connecting the outlet of the rapid cooling body 50 to the inlet of the coolant cooler 32.

In a case in which the circulation pump 70 is mounted on the coolant collection channel 60, the coolant collection channel 60 includes a rapid cooling body—circulation pump connection channel 62 for connecting the outlet of the rapid cooling body 50 to the inlet of the circulation pump 70 and a circulation pump—coolant cooler connection channel 64 for connecting the outlet of the circulation pump 70 to the inlet of the coolant cooler 32.

The refrigerator according to this embodiment further includes a vibration exciter 80 mounted at the rapid cooling body 50 for exciting the rapid cooling body 50.

The vibration exciter 80 excites the coolant W and the beverage using ultrasonic waves to accelerate heat transmission. The vibration exciter 80 may be embodied by an ultrasonic vibration exciter. The vibration exciter 80 may be mounted at the outside of the rapid cooling body 50 in a contact manner.

Meanwhile, the rapid cooling body 50 further includes a plurality of dampers 90 mounted at the bottom of the outer cylindrical body 55 for supporting the rapid cooling body 50.

The rapid cooling body 50 is hung from the inner wall of the storage chambers F and R or spaced apart from shelves 92 mounted in the storage chambers F and R by the dampers 90. The dampers 90 are arranged at the bottom of the rapid cooling body 50 at predetermined intervals.

The dampers 90 serve to absorb vibration or impact, which may be generated during rapid cooling of the beverage. Preferably, the dampers 90 are formed of an elastic material.

Figure 6:
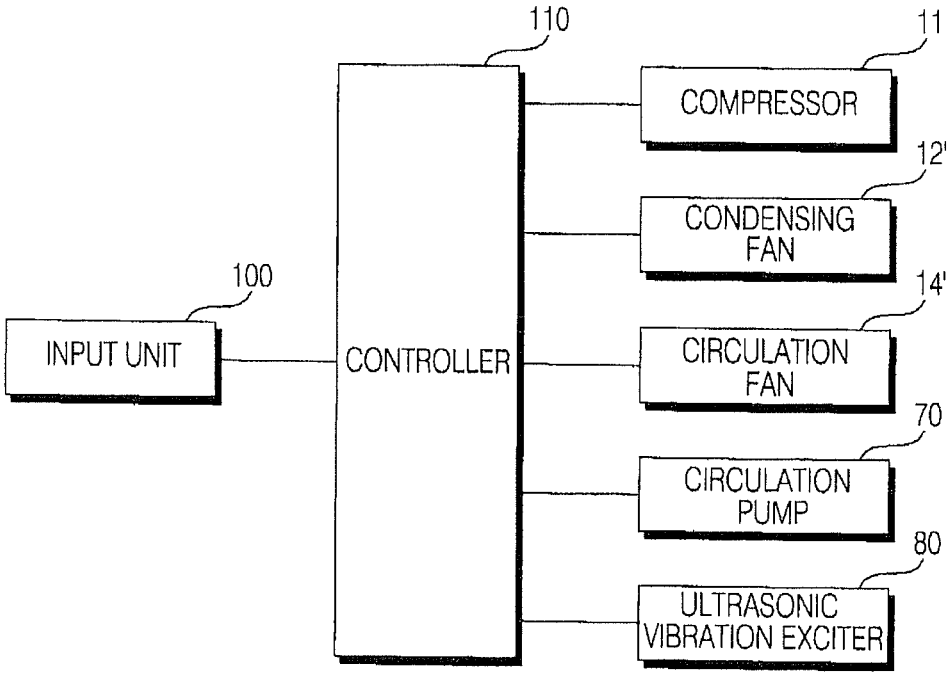
FIG. 6 is a control block diagram of the refrigerator according to the first embodiment of the present invention.

FIG. 6 is a control block diagram of the refrigerator according to the first embodiment of the present invention.

In this embodiment, the refrigerator further includes an input unit 100 for allowing a user to input temperature of the storage chambers or a rapid beverage cooling command and a controller 110 for controlling the refrigerator according to the input of the input unit 100 and for driving the circulation pump 70 when the rapid beverage cooling command is input through the input unit 100.

When desired temperature of the storage chambers is input through the input unit 100, the controller 110 controls the compressor 11, the condensing fan 12', and the circulation fan 14' based on the desired temperature input through the input unit 100 and the temperature of the storage chambers, and controls the circulation pump 70 and the vibration exciter 80 according to the rapid beverage cooling command input through the input unit 100.

The refrigerator with the above-stated construction according to the present invention is operated as follows.

First, when a user opens the doors 5 and 6, puts a beverage container C into the chilling case 20 through the beverage inlet and output port 23, and closes the doors 5 and 6, the beverage container C is received in the rapid cooling body 50 in a state in which the chilling case 20 is disposed between the beverage container C and the rapid cooling body 50.

Subsequently, when the user input a rapid beverage cooling command through the input unit 100, the controller 110 controls the circulation pump 70 to be driven.

When the rapid beverage cooling command is input in a state in which the compressor is stopped, the controller 110 controls the compressor 11 to be driven. On the other hand, when the rapid beverage cooling command is input in a state in which the compressor is driven, the controller 110 controls the compressor 11 to be continuously driven.

When the compressor is driven, a refrigerant L sequentially passes through the compressor 11, the condenser 12, the expander 13, and the evaporator 14 to cool the evaporator 14.

When the circulation pump 70 is driven, a coolant W in the coolant collection channel 60 passes through the coolant channel of the coolant cooler 30. As this time, the coolant W is cooled by the evaporator 14. After that, the coolant W passes through the coolant supply channel 40, and is then supplied to the rapid cooling body 50.

At this time, the coolant W is distributed from the common channel 42 to the branch channels 44 and 46, and is then supplied to the internal channel 54 of the rapid cooling body 50. In the internal channel 54, the coolant W is dispersed in the circumferential direction and in the downward direction. Subsequently, the coolant W is horizontally sprayed to the case receiving part 28 through the spray holes 52 of the inner cylindrical body 53 at high speed.

The coolant W sprayed through the spray holes 52 at high speed is sprayed to the outside of the chilling case 20 in the circumferential direction of the case receiving part 28 and in the vertical direction of the case receiving part 28. As a result, the coolant W perpendicularly collides with the outside of the chilling case 20 to create an impinging jet of the coolant W.

The coolant W perpendicularly colliding with the outside of the chilling case 20 cools the chilling case 20 at high heat transmission efficiency. Since the coolant has higher density than a general gas coolant, the chilling case 20 is more rapidly cooled than when a gas coolant is sprayed to the chilling case 20.

The coolant W colliding with the outside of the chilling case 20 falls due to gravity while splashing in all directions in the vicinity of the chilling case 20 inside the case receiving part 28, flows to the bottom of the case receiving part 28, and is then transmitted to the coolant collection channel.

When the circulation pump 70 is driven as described above, the coolant W is circulated through the coolant cooler 32, the coolant channel P of the coolant supply channel 40, the internal channel 54 of the rapid cooling body 50, the spray holes 52, the case receiving part 28, and the coolant collection channel 60 to cool the chilling case 20. As a result, heat is transmitted form the beverage container C placed in the chilling case 20 to the chilling case 20 in a state in which the beverage container C is in tight contact with the chilling case 20.

Meanwhile, during the rapid cooling as described above, the controller 110 controls the vibration exciter 80 to be operated such that the vibration exciter 80 excites the rapid cooling body 50 using ultrasonic waves.

The ultrasonic waves excite a beverage contained in the beverage container as well as the coolant W, with the result that transmission of heat from the beverage is further accelerated.

Meanwhile, when a rapid cooling stop command is input through the input unit 100 or when a predetermined time elapses after the rapid cooling command, the controller 110 controls the vibration exciter 80 and the circulation pump 70 to be stopped.

When the vibration exciter 80 is stopped, the ultrasonic waves are not transmitted into the rapid cooling body 50. When the circulation pump 70 is stopped, the movement of the coolant W is stopped.

When the user opens the doors 5 and 6, and takes the beverage container C out from the chilling case 20, the coolant W is not attached to the outside of the beverage container C. Consequently, it is possible for the user to drink the rapidly cooled beverage in a state in which the beverage container C is kept sanitary.

Figure 7:
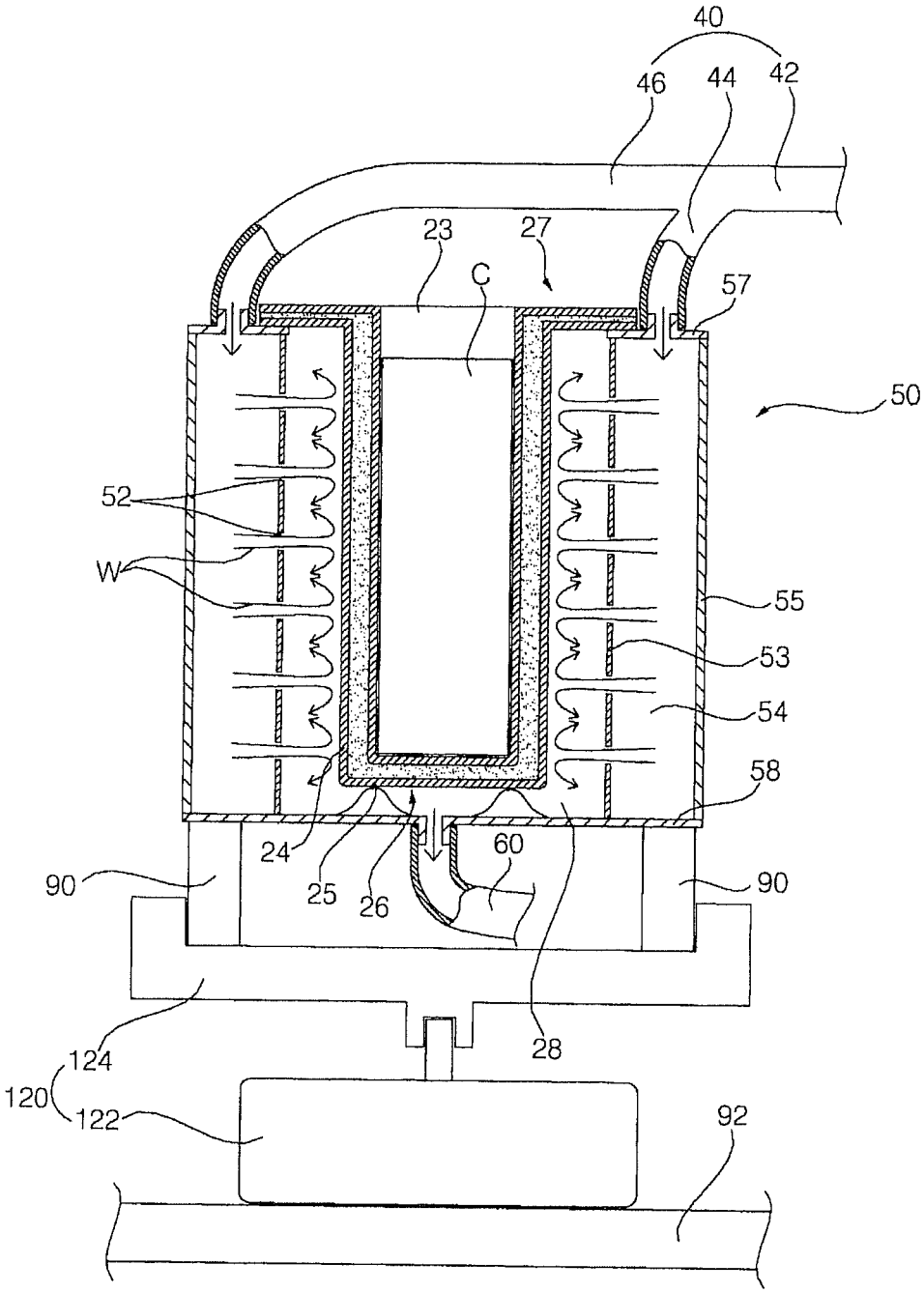
FIG. 7 is a sectional view illustrating a principal part of a refrigerator according to a second embodiment of the present invention.
Figure 8:
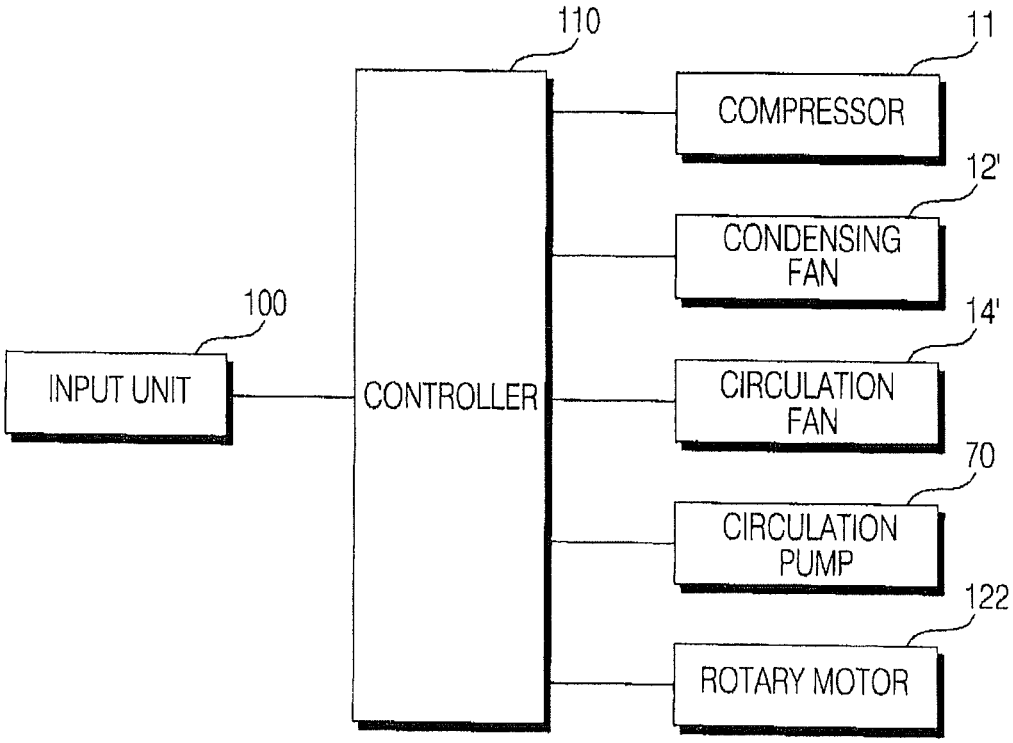
FIG. 8 is a control block diagram of the refrigerator according to the second embodiment of the present invention.

FIG. 7 is a sectional view illustrating a principal part of a refrigerator according to a second embodiment of the present invention, and FIG. 8 is a control block diagram of the refrigerator according to the second embodiment of the present invention.

As shown in FIG. 7, the refrigerator according to this embodiment further includes a rapid cooling body rotating mechanism 120 for rotating the rapid cooling body 50. The refrigerator according to this embodiment is identical or similar in construction and operation to the refrigerator according to the first embodiment except the rapid cooling body rotating mechanism 120, and therefore, a detailed description thereof will not be given.

The beverage inlet and outlet port 23 is formed at the top of the chilling case 20, and the rapid cooling body rotating mechanism 120 is mounted below the rapid cooling body 50.

The rapid cooling body rotating mechanism 120 includes a rotary motor 122 mounted in the refrigerator body 2 and a power transmission member for transmitting drive force from the rotary motor 122 to the rapid cooling body 50.

In the refrigerator according to this embodiment, it is possible for the rapid cooling body rotating mechanism 120 to not only rotate the rapid cooling body 50 but also support the rapid cooling body 50. The rotary motor 122 is mounted in the refrigerator body 2, and the power transmission member is embodied by a rotary plate 124 connected to a rotary shaft of the rotary motor 122. The rapid cooling body 50 is disposed on the rotary plate 124. When the rotary motor 122 is driven, the rotary plate 124 is rotated together with the rapid cooling body 50.

In the refrigerator according to this embodiment, the rapid cooling body 50 may be mounted in the refrigerator body 2, and the power transmission member may include a driving gear mounted at the rotary motor 122 and a driven gear integrally formed at the outside of the rapid cooling body 50. When the driving gear is rotated according to the rotation of the rotary motor 122, the driven gear rotates the rapid cooling body 50 in a state in which the driven gear is engaged with the driving gear.

In the refrigerator according to this embodiment, the power transmission member may include a rotary plate 124 on which the rapid cooling body 50 is disposed, a driven gear formed at the rotary plate 124, and a driving gear mounted at the rotary motor 122 such that the driving gear is engaged with the driven gear. When the driving gear is rotated according to the rotation of the rotary motor 122, the driven gear is rotated in a state in which the driven gear is engaged with the driving gear. At this time, the rotary plate 124 is rotated together with the rapid cooling body 50 according to the rotation of the driven gear.

It is possible for the rotary motor 122 to rotate in a unidirectional manner or in a bidirectional manner.

Since the coolant supply channel 40 and the coolant collection channel 60 are connected to the rapid cooling body 50, it is preferable for the rotary motor 122 to rotate in alternating directions such that the coolant supply channel 40 and the coolant collection channel 60 are not twisted.

When a rapid beverage cooling command is input through the input unit 100, the controller 110 controls the circulation pump 70 to be driven, and, in addition, controls the rapid cooling body rotating mechanism 120, in particular, the rotary motor 122 to be driven.

In the refrigerator according to this embodiment, the rapid cooling body 50 is rotated when the rapid cooling body rotating mechanism 120, in particular, the rotary motor 122 is driven. At this time, the coolant W and a beverage contained in the beverage container C are stirred by the rapid cooling body 50, with the result that heat transmission between the coolant W and the beverage contained in the beverage container C is accelerated.

In particular, when the rotary motor 122 is driven in alternating directions, the beverage contained in the beverage container C actively moves due to inertia, with the result that the beverage is more rapidly cooled.

Figure 9:
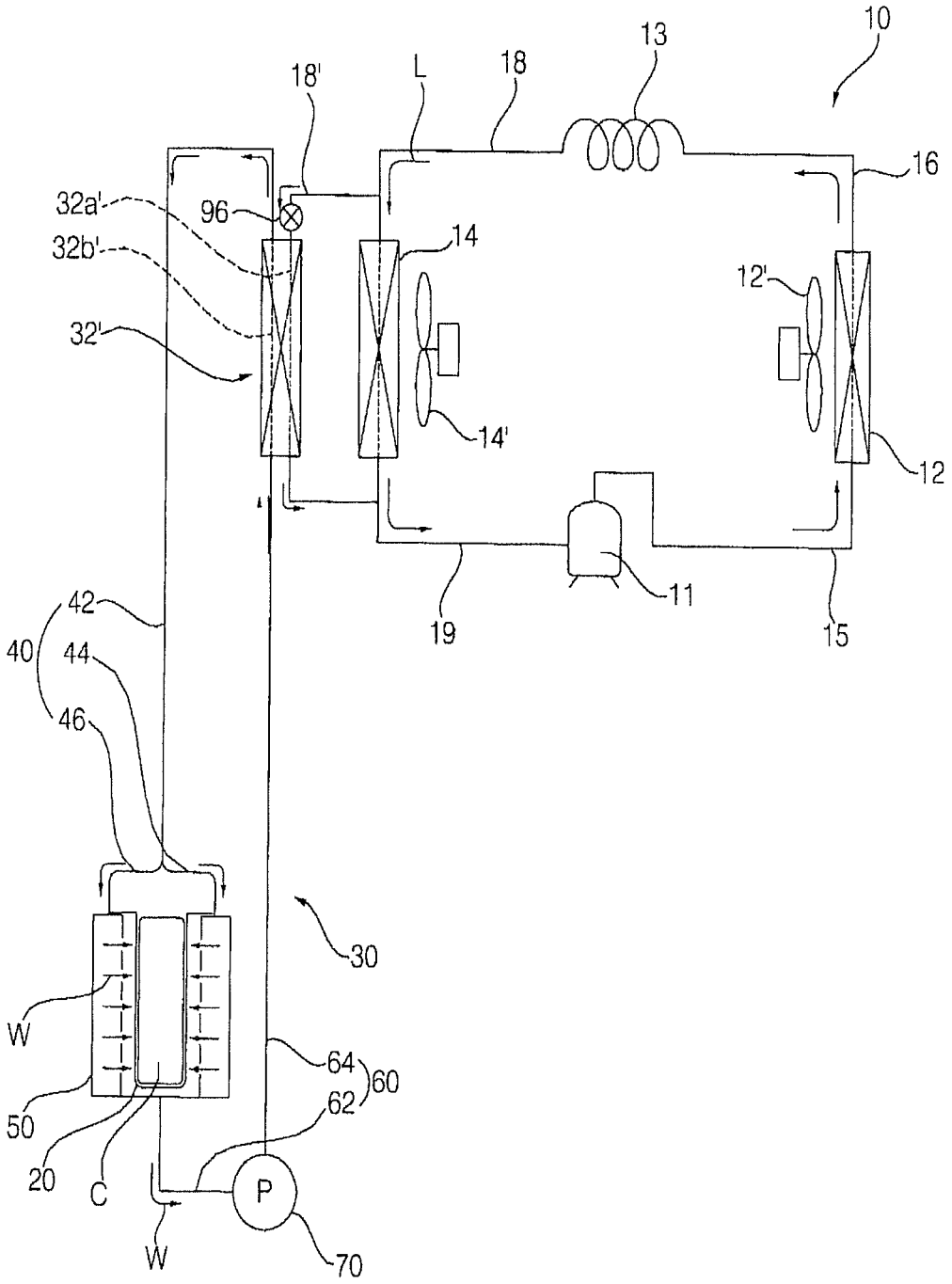
FIG. 9 is a construction view schematically illustrating the flow of a refrigerant and a coolant in a refrigerator according to a third embodiment of the present invention.

FIG. 9 is a construction view schematically illustrating the flow of a refrigerant and a coolant in a refrigerator according to a third embodiment of the present invention.

In the refrigerator according to this embodiment, as shown in FIG. 9, a coolant cooler 32' is embodied by a heat exchanger connected in parallel to the evaporator 14 of the refrigeration cycle device 10 for performing heat exchange between a refrigerant channel 32*a*', through which a refrigerant flows, and a coolant channel 32*b*'. The refrigerator according to this embodiment is identical or similar in construction and operation to the refrigerator according to the first embodiment except the coolant cooler 32', and therefore, a detailed description thereof will not be given.

The evaporator 14 and the coolant cooler 32' are connected in parallel to each other via refrigerant pipes 18 and 18' through which a refrigerant is introduced. The evaporator inlet pipe 18 is connected between the evaporator 14 and the expander 13, and the refrigerant channel 32*a*' of the coolant cooler 32' is connected to the evaporator inlet pipe 18 via the coolant cooler inlet pipe 18'.

The evaporator 14 and the coolant cooler 32' are connected in parallel to each other via refrigerant pipes 19 and 19' through which a refrigerant is discharged. The evaporator outlet pipe 18 is connected between the evaporator 14 and the compressor 11, and the refrigerant channel 32*a*' of the coolant cooler 32' is connected to the evaporator outlet pipe 19 via the coolant cooler outlet pipe 19'.

The coolant channel 32*b*' of the coolant cooler 32' is connected to the coolant supply channel 40. Also, the coolant channel 32*b*' of the coolant cooler 32' is connected to the coolant collection channel 60.

The coolant cooler 32' may be embodied by a double pipe type heat exchanger configured in a structure in which one of the refrigerant and coolant channels 32*a*' and 32*b*' constitutes an inner pipe and the other of the refrigerant and coolant channels 32*a*' and 32*b*' constitutes an outer pipe surrounding the inner pipe. Alternatively, the coolant cooler 32' may be embodied by a plate type heat exchanger configured in a structure in which the refrigerant channel 32*a*' and the coolant channel 32*b*' are alternately disposed while a plate-shaped heat transmission member is disposed between the refrigerant channel 32*a*' and the coolant channel 32*b'*.

In the refrigerator according to this embodiment, the controller 110 controls a rapid cooling valve 96 when a rapid cooling command is input. When a rapid cooling mode is input, the controller 110 controls the rapid cooling valve 96 to open the coolant cooler inlet pipe 18' and the coolant cooler outlet pipe 19' such that a refrigerant flows to the coolant cooler 32'. When the rapid cooling mode is not input, the controller 110 controls the rapid cooling valve 96 to close the coolant cooler inlet pipe 18' or the coolant cooler outlet pipe 19' such that a refrigerant does not flow to the coolant cooler 32'.

In the refrigerator according to this embodiment, in a general operation in which a rapid cooling command is not input, the controller 110 controls the compressor 11, the condensing fan 12', and the circulation fan 14' to be driven and, in addition, controls the rapid cooling valve 96 in a closed mode. The refrigerant is circulated through the compressor 11, the condenser 12, the expander 13, and the evaporator 14. The storage chambers F and R are cooled at higher efficiency than when the refrigerant flows to the coolant cooler 32'.

On the other hand, in a rapid cooling operation in which a rapid cooling command is input, the controller 110 controls the compressor 11, the condensing fan 12', and the circulation fan 14' to be driven, controls the rapid cooling valve 96 in a closed mode, and controls the circulation pump 70 to be driven.

A refrigerant L sequentially passes through the compressor 11, the condenser 12, and the expander 13, and is distributed to the evaporator 14 and the coolant cooler 32' to cool the evaporator 14 and the coolant cooler 32'. After cooling the evaporator 14 and the coolant cooler 32', the refrigerant L is collected to the compressor 11.

A coolant W in the coolant collection channel 60 flows to the coolant channel 32*b*' of the coolant cooler 32'. At this time, heat is transmitted from the coolant W to the refrigerant L. After that, the coolant W flows to the rapid cooling body 50 via the coolant supply channel 40. The coolant W cools the chilling case 20 in the rapid cooling body 50, and is then collected to the coolant collection channel 60.

Figure 10:
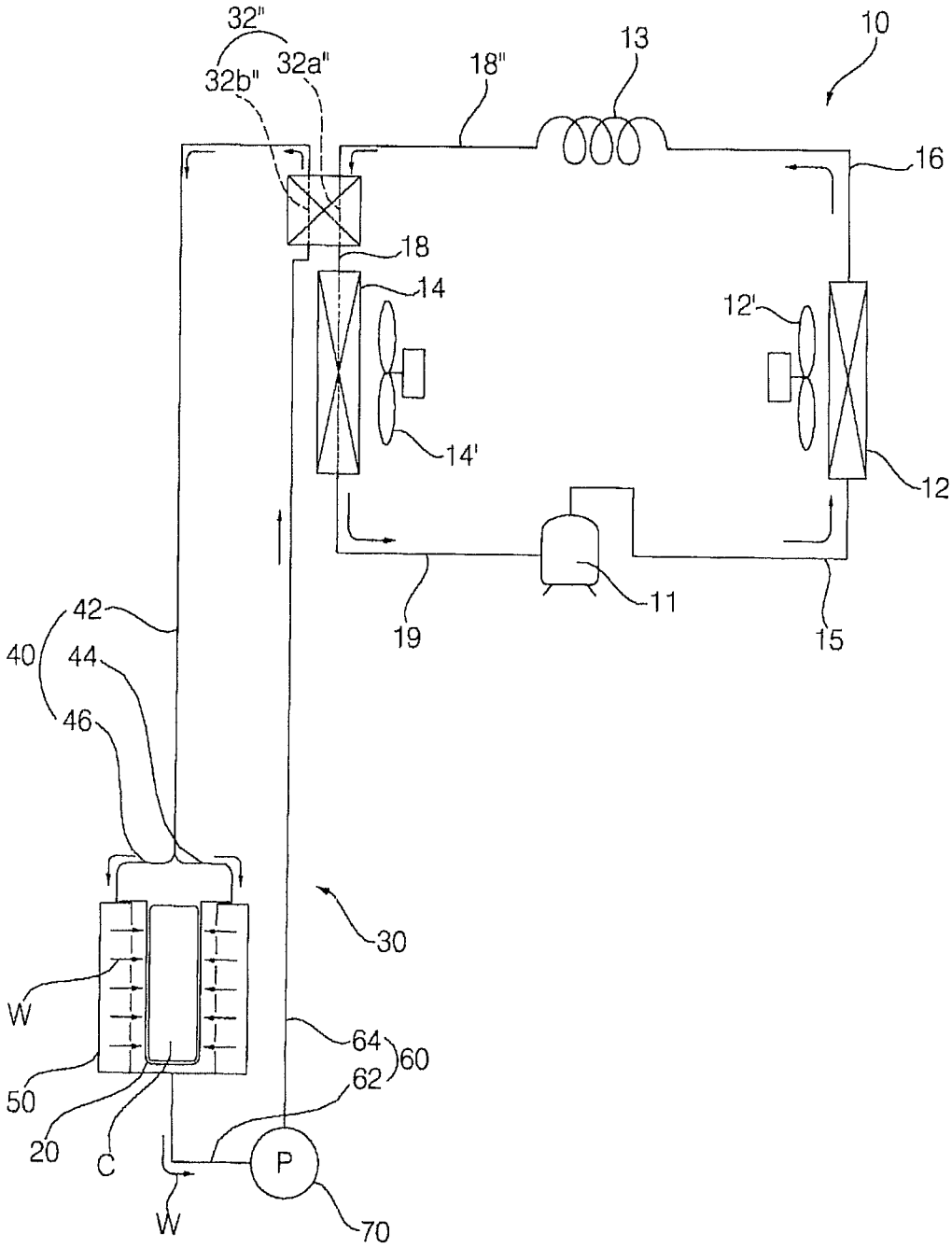
FIG. 10 is a construction view schematically illustrating the flow of a refrigerant and a coolant in a refrigerator according to a fourth embodiment of the present invention.

FIG. 10 is a construction view schematically illustrating the flow of a refrigerant and a coolant in a refrigerator according to a fourth embodiment of the present invention.

In the refrigerator according to this embodiment, as shown in FIG. 10, a coolant cooler 32" is embodied by a heat exchanger connected in series to the evaporator 14 of the refrigeration cycle device 10 for performing heat exchange between a refrigerant channel 32*a*", through which a refrigerant flows, and a coolant channel 32*b*". The refrigerator according to this embodiment is identical or similar in construction and operation to the refrigerator according to the first embodiment except the coolant cooler 32", and therefore, a detailed description thereof will not be given.

The coolant cooler 32" may be disposed between the evaporator 14 and the expander 13 such that a refrigerant, expanded by the expander 13, passes though the coolant cooler 32" and then flows to the evaporator 14. Alternatively, the coolant cooler 32" may be disposed between the evaporator 14 and the compressor 11 such that a refrigerant, expanded by the expander 13, passes though the coolant cooler 32" and then flows to the compressor 11.

It is preferable for the rapid cooling device 30 to rapidly cool a beverage within predetermined time (for example, 5 minutes). Also, it is preferable for the coolant cooler 32" to be disposed between the expander 13 and the evaporator 14.

The evaporator 14 and the coolant cooler 32" are connected in series to each other via refrigerant pipes 18 and 18" through which a refrigerant is introduced. The evaporator inlet pipe 18 is connected between the evaporator 14 and the coolant cooler 32", and the refrigerant channel 32*a*" of the coolant cooler 32" is connected to the expander 13 via the coolant cooler inlet pipe 18".

The coolant channel 32*b*" of the coolant cooler 32" is connected to the coolant supply channel 40. Also, the coolant channel 32*b*" of the coolant cooler 32" is connected to the coolant collection channel 60.

The coolant cooler 32" may be embodied by a double pipe type heat exchanger configured in a structure in which one of the refrigerant and coolant channels 32*a*" and 32*b*" constitutes an inner pipe and the other of the refrigerant and coolant channels 32*a*" and 32*b*" constitutes an outer pipe surrounding the inner pipe. Alternatively, the coolant cooler 32" may be embodied by a plate type heat exchanger configured in a structure in which the refrigerant channel 32*a*" and the coolant channel 32*b*" are alternately disposed while a plate-shaped heat transmission member is disposed between the refrigerant channel 32*a*" and the coolant channel 32*b"*.

In the refrigerator according to this embodiment, when a rapid cooling operation is performed, a refrigerant L sequentially passes through the compressor 11, the condenser 12, and the expander 13. Subsequently, the refrigerant L cools the coolant cooler 32" while the refrigerant L passes through the refrigerant channel 32*a*" of the coolant cooler 32". After that, the refrigerant L cools the evaporator 14 while the refrigerant L passes through the evaporator 14, and is then collected to the compressor 11.

A coolant W in the coolant collection channel 60 flows to the coolant channel 32*b*" of the coolant cooler 32". At this time, heat is transmitted from the coolant W to the refrigerant L. After that, the coolant W flows to the rapid cooling body 50 via the coolant supply channel 40. The coolant W cools the chilling case 20 in the rapid cooling body 50, and is then collected to the coolant collection channel 60.

Meanwhile, the present invention is not limited to the above embodiments. In addition to beverages, ice or meat may be placed in the rapid cooling device 30 such that the ice or the meat may be rapidly cooled by the rapid cooling device 30. Alternatively, the ice or the meat may be surrounded by the chilling case 20 in a contact manner such that the ice or the meat may be rapidly cooled by the chilling case 20.

As apparent from the above description, the present invention with the above-stated construction has an effect in that the coolant is sprayed to the outside of the chilling case, and the beverage is cooled by the chilling case, i.e., the beverage is cooled in a state in which the beverage container is not in direct contact with the coolant, whereby the coolant is not present at the outside of the beverage container, and therefore, the beverage container is kept sanitary.

Also, the present invention has an effect in that the coolant sprayed to the chilling case is prevented from being discharged to the outside through the space defined between the chilling case and the rapid cooling device, and therefore, it is possible to use the coolant for a long time and to minimize the number of injection times of the coolant.

Also, the present invention has an effect in that the chilling case is separated from the rapid cooling device such that the chilling case can be easily cleaned, and therefore, it is possible to keep the chilling case clean.

Also, the present invention has an effect in that the shape of the chilling case is deformed such that the chilling case surrounds the beverage container, and therefore, it is possible to maximize the surface contact area between the chilling case and the beverage container, thereby improving beverage cooling performance.

Also, the present invention has an effect in that the coolant is sprayed to the outside of the chilling case in the form of an impinging jet, and therefore, it is possible to maximize heat transmission efficiency.

Also, the present invention has an effect in that a smaller amount of noise is generated than when a blowing fan is mounted to forcibly blow cool air in the storage chambers to the beverage container, and, in addition, it is possible to minimize power consumption.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A refrigerator, comprising:

a refrigerator body having a storage chamber defined therein;

a refrigeration cycle device to cool the storage chamber;

a chilling case to receive a beverage container such that the chilling case surrounds the beverage container in a contact manner; and a rapid cooling device, having a case receiving portion that receives the chilling case, to cool a coolant using the refrigeration cycle device and spray the cooled coolant onto an outer circumferential surface of the chilling case, wherein the rapid cooling device comprises a rapid cooling body, in which the case receiving portion is defined, having a plurality of spray holes to spray the coolant onto the outer circumferential surface of the chilling case, and wherein the rapid cooling body comprises:

an inner cylindrical body, in which the case receiving portion is defined and through which the plurality of spray holes is formed to spray the coolant onto the outer circumferential surface of the chilling case; and an outer cylindrical body that surrounds the inner cylindrical body to define an internal channel to allow a coolant to pass between the inner cylindrical body and the outer cylindrical body.

2. The refrigerator according to claim 1, wherein the chilling case comprises:

a hear transmission bag disposed in contact with the beverage container such that the heat transmission bag is deformed in correspondence to a shape of the beverage container; and a heat transmission material disposed in the heat transmission bag.

3. The refrigerator according to claim 1, wherein the chilling case comprises:

a cylindrical body received in the case receiving portion, the cylindrical body having a beverage inlet and output port formed at a top thereof, the cylindrical body having a closed circumferential portion and a closed bottom; and a cover that protrudes from the cylindrical body to close a space defined between the cylindrical body and an upper end of the case receiving portion.

4. The refrigerator according to claim 1, further comprising a rapid cooling body rotating mechanism to rotate the rapid cooling body.

5. The refrigerator according to claim 4, wherein the chilling case is provided at a top thereof with a beverage inlet and output port, and wherein the rapid cooling body rotating mechanism is mounted below the rapid cooling body.

6. The refrigerator according to claim 1, further comprising a vibration exciter mounted at the rapid cooling body to excite the rapid cooling body.

7. The refrigerator according to claim 6, further comprising a plurality of dampers mounted at a bottom of the outer cylindrical body to support the rapid cooling body.

8. The refrigerator according to claim 1, wherein the rapid cooling body further comprises:

a top plate that closes an upper end of the rapid cooling body between the inner cylindrical body and the outer cylindrical body; and a bottom plate that closes a lower end of the outer cylindrical body.

9. The refrigerator according to claim 1, wherein the rapid cooling device further comprises:

a coolant cooler, having a coolant channel to allow the coolant to pass therethrough, that performs heat exchange between the coolant and a refrigerant of the refrigeration cycle device to cool the coolant;

a coolant supply channel that guides the coolant cooled by the coolant cooler to the rapid cooling body;

a coolant collection channel that guides the coolant discharged from the rapid cooling body to the coolant cooler; and a circulation pump mounted on at least one of the coolant supply channel or the coolant collection channel to circulate the coolant.

10. The refrigerator according to claim 9, wherein the coolant supply channel is connected to a top of the rapid cooling body, and the coolant collection channel is connected to a bottom of the rapid cooling body.

11. The refrigerator according to claim 9, wherein the coolant cooler comprises a heat exchanger mounted at a surface of an evaporator of the refrigeration cycle device in a surface contact manner.

12. The refrigerator according to claim 9, wherein the coolant cooler comprises a heat exchanger connected in parallel to an evaporator of the refrigeration cycle device to perform heat exchange between a refrigerant channel, through which a refrigerant flows, and a coolant channel.

13. The refrigerator according to claim 9, wherein the coolant cooler comprises a heat exchanger connected in series to an evaporator of the refrigeration cycle device to perform heat exchange between a refrigerant channel, through which a refrigerant flows, and a coolant channel.

14. The refrigerator according to claim 4, wherein the rapid cooling body rotating mechanism comprises:

a rotator plate, on which the rapid cooling body is disposed; and a rotary motor that rotates the rotary plate.

15. The refrigerator according to claim 1, wherein the refrigerator cycle device includes a compressor, a condenser, an expander, and an evaporator in fluid communication.

16. The refrigerator according to claim 1, wherein the evaporator performs heat exchange with a coolant cooler of the rapid cooling device, such that heat is exchanged between a refrigerant of the refrigeration cycle device and the coolant of the rapid cooling device.

17. The refrigerator according to claim 1, further comprising:

a controller that controls the refrigeration cycle device and a circulation pump of the rapid cooling device.

18. A refrigerator, comprising:

a refrigerator body having a storage chamber defined therein;

a refrigeration cycle device to cool the storage chamber;

a chilling case to receive a beverage container such that the chilling case surrounds the beverage container in a contact manner; and a rapid cooling device, having a case receiving portion that receives the chilling case, to cool a coolant using the refrigeration cycle device and spray the cooled coolant onto an outer circumferential surface of the chilling case, wherein the rapid cooling device comprises a rapid cooling body, in which the case receiving portion is defined, having a plurality of spray holes to spray the coolant onto the outer circumferential surface of the chilling case, and wherein the rapid cooling body comprises:

an inner cylindrical body, in which the case receiving portion is defined and through which the plurality of spray holes is formed spaced along a circumference thereof at predetermined intervals to spray the coolant onto the outer circumferential surface of the chilling case;

an outer cylindrical body that surrounds the inner cylindrical body to define an internal channel to allow a coolant to pass between the inner cylindrical body and the outer cylindrical body and be sprayed onto the outer circumferential surface of the chilling case.

19. A refrigerator, comprising:

a refrigerator body having a storage chamber defined therein;

a refrigeration cycle device to cool the storage chamber;

a chilling case to receive a beverage container such that the chilling case surrounds the beverage container in a contact manner;

a rapid cooling device, having a case receiving portion that receives the chilling case, to cool a coolant using the refrigeration cycle device and spray the cooled coolant onto an outer circumferential surface of the chilling case, wherein the rapid cooling device comprises a rapid cooling body, in which the case receiving portion is defined, having a plurality of spray holes to spray the coolant onto the outer circumferential surface of the chilling case, wherein the rapid cooling body comprises:

an inner cylindrical body, in which the case receiving portion is defined and through which the plurality of spray holes is formed to spray the coolant onto the outer circumferential surface of the chilling case; and an outer cylindrical body that surrounds the inner cylindrical body to define an internal channel to allow a coolant to pass between the inner cylindrical body and the outer cylindrical body; and a rapid cooling body rotating mechanism to rotate the rapid cooling body.

20. The refrigerator according to claim 19, wherein the rapid cooling body rotating mechanism comprises:

a rotator plate, on which the rapid cooling body is disposed; and a rotary motor that rotates the rotary plate.

* * * * *